United States Patent [19]

Tsumura

[11] Patent Number: 4,489,493

[45] Date of Patent: Dec. 25, 1984

[54] CHAIN SAW GUIDE BAR

[75] Inventor: Toshihiro Tsumura, Miki, Japan

[73] Assignee: Suehiro Seiko Kabushiki Kaisha, Miki, Japan

[21] Appl. No.: 480,339

[22] Filed: Mar. 30, 1983

[30] Foreign Application Priority Data

Jul. 21, 1982 [JP] Japan ..... 57-111585[U]

[51] Int. Cl.[3] ..... B27B 17/02

[52] U.S. Cl. ..... 30/387; 83/821

[58] Field of Search ..... 30/387, 386, 385, 384; 83/825, 824, 820, 821

[56] References Cited

U.S. PATENT DOCUMENTS 2,316,997 4/1943 Smith ..... 30/385
3,545,505 12/1970 De Wesse ..... 83/821
3,762,047 10/1973 Scott-Jackson ..... 30/385
3,955,279 5/1976 Pierson ..... 30/384

FOREIGN PATENT DOCUMENTS 493111 5/1953 Canada ..... 30/386
144101 11/1981 Japan .

*Primary Examiner*—Jimmy C. Peters
*Attorney, Agent, or Firm*—Marshall, O'Toole, Gerstein, Murray & Bicknell

[57] ABSTRACT

This disclosure relates to a chain saw guide bar including a main or body part and a front part. The two parts fit together in a tongue-and-groove joint having a V configuration, and the parts are secured together by fasteners such as rivets. A chain guide groove is formed in the periphery of the two parts, and the front part may include a rotatable sprocket for the chain.

8 Claims, 2 Drawing Figures

CHAIN SAW GUIDE BAR

This invention relates to a chain saw guide bar, particularly to such a construction that is divided into a main part and a front part which are secured together.

The bar of a chain saw supports the saw chain which moves at a high speed while cutting. A relatively large force is exerted to drive the chain around the bar, and this force produces a large torque on the front part of the bar, in the direction of rotation of the chain. Particularly while cutting with the front part pressed against the wood, the cutting load on the chain varies with time. This variation changes the torque, producing a varying impact load on the front part of the bar, which may cause failure of or damage to the front part, particularly in the case of a guide bar having a divided construction.

In addition, when the front part bites into the wood, a vertical, varying bending load may be produced on the front part because the saw is supported by the engine unit.

Consequently, in a guide bar having a divided construction, the connection between the main and the front parts is very important, and the bar is required to be as rigid as a unitary bar.

It is a general object of this invention to provide a chain saw guide bar construction of the divided type which is less subject to failure. A bar in accordance with the present invention comprises a main or body part and a front part. The two parts fit together in a tongue-and-groove joint having a V configuration, and the parts are secured together by fasteners such as rivets. A chain guide groove is formed in the periphery of the two parts, and the front part may include a rotatable sprocket for the chain.

A preferred embodiment of the invention is described in detail with reference to the accompanying figures of the drawing, wherein.

Figure 1:
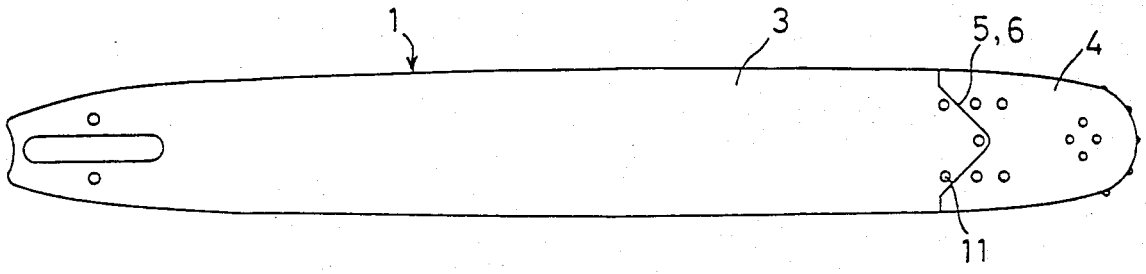
FIG. 1 is a side view of guide bar in accordance with this invention.
Figure 2:
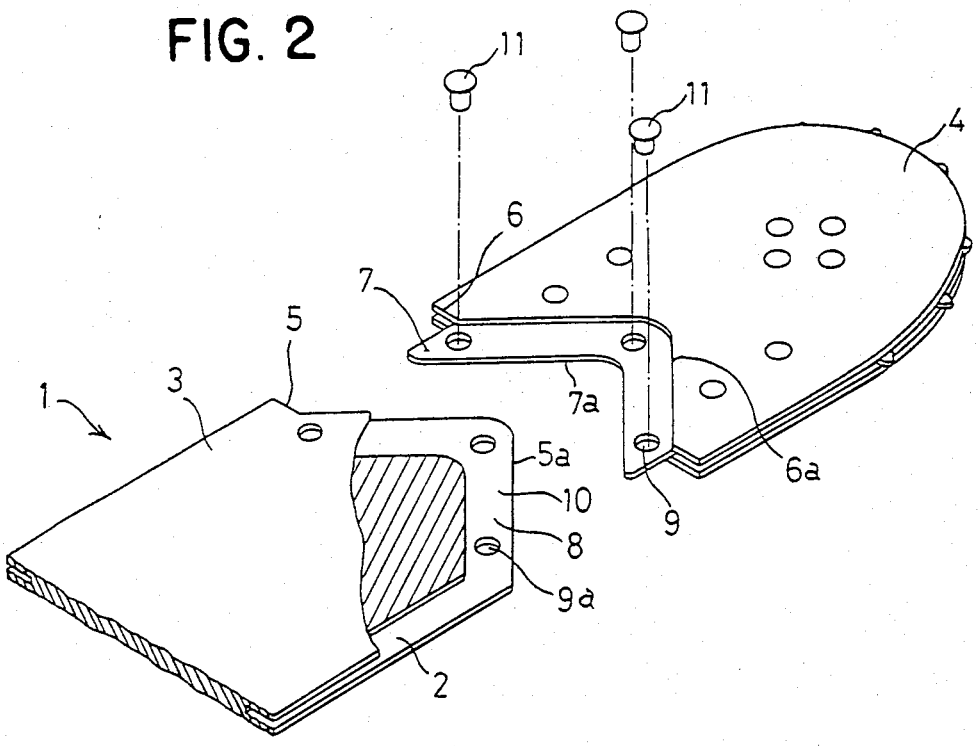
FIG. 2 is a fragmentary exploded perspective view on an enlarged scale of a portion of the bar.

With reference to the drawing, a chain saw guide bar 1 has a chain guide groove 2 (FIG. 2) formed in its peripheral edge. The bar 1 is divided into a main or body part 3 and a front part 4, the front part 4 comprising the forwardmost tip of the bar.

The two parts 3 and 4 are connected together by a tongue-and-groove joint having a V configuration. The joint includes a rearwardly extending tongue 7 formed by cut edges 6*a* on the front 4 and a mating groove 8 formed by cut edges 5*a* in the main part 3. The main part 3 is formed, in this example, of a single piece of metal and the chain guide groove 2 is formed along its longitudinal side edges as previously mentioned. The mating groove 8 has the same thickness as the guide groove 2 and thus forms a continuation around the forward end of the part 3, of the groove 2. The tongue 7 has a longitudinal width and a thickness that are substantially equal to the groove 8, so that the tongue fits snugly within the groove. The apexes of the V on both parts 3 and 4 are preferably rounded, and the apexes extend toward the forward end of the bar. The tongue 7 thus forms a forwardly extending recess 7*a* that receives the bottom of the groove 8. Three fastener holes 9 are formed in the tongue 7 and three aligned holes 9*a* are formed in the walls forming the groove 8, the holes receiving fasteners such as rivets 11. Preferably one set of the holes is formed at the apex of the V and the other two holes are formed near the outer ends of the V, the holes being symmetrical about the longitudinal axis of the bar.

The front part 4 may be formed by three flat plates that are secured together by rivets, and a rotatable chain sprocket may be provided between the two outer plates at the end of the bar.

In use, the guide bar 1 is attached to the chain saw machine, and the saw chain is driven along the guide groove 2. In a cutting operation with the front end of the guide bar pressed against the wood, a rotational torque is produced by the cutting impact load varying in time, and the load is received by the junction between the V-shaped oblique edges 5*a* and 6*a* at the joint between the parts 3 and 4. As a result, the force is dispersed along the relatively long edges, providing the guide bar with a high resistance to the rotational torque and keeping the rivets from loosening.

The junction between the parts 3 and 4 is a three-layer tongue-and-groove construction along a V-shaped oblique cut edge, thereby increasing the strength of the joint against the vertical bending stresses on the bar.

I claim:

1. A chain saw guide bar comprising a three-layer main part having longitudinal side edges and a forward end, a three-layer front part having longitudinal side edges and a rearward end, a joint rigidly securing said forward and rearward ends together with said side edges of said parts in alignment, said joint comprising three V-shaped end edges formed on said three layers of each of said parts, said end edges extending from one side edge to the other side edge of said parts, on one of said parts said end edge of the center of said three layers being recessed from said end edges of the outer two of said three layers and thereby forming a groove between said outer two layers, on the other of said parts said end edge of the center of said three layers projecting from said end edges of the outer two of said three layers and thereby forming a tongue between said outer two layers, said groove being complementary with and receiving said tongue, and said three end edges of one of said parts substantially abutting said three end edges of the other of said parts, and fastener means extending through said tongue and said groove and securing said parts together.

2. A chain saw guide bar according to claim 1, wherein said groove is formed in said main part, and said tongue is formed in said front part.

3. A chain saw guide bar according to claim 1, wherein the apex of said V-shaped end edges is at the forward end of said joint, said groove and said tongue extending along said V-shape so that said tongue complements said groove.

4. A chain saw guide bar according to claim 2, wherein the apex of said V-shape is at the froward end of said joint, said groove and said tongue extending along said V-shape so that said tongue complements said groove.

5. A chain saw guide bar according to claim 1, wherein said parts have a chain guide groove in said side edges thereof, and said center of said three layers has the same thickness as said guide groove.

6. A chain saw guide bar according to claim 1, wherein holes are formed in said joint and receive said fastener means, said holes being substantially symmetrical about the longitudinal axis of said bar.

7. A chain saw guide bar comprising a main part having a foward end, a front part having a rearward end, a joint between said forward and rearward ends and formed by a tongue portion on one of said parts and a groove portion on the other of said parts, and fasteners extending through said joint and securing said parts together, each of said tongue and said groove portions forming three V-shaped edges, and each of said edges of said tongue portion of said joint abutting a complementary shaped edge of said groove portion of said joint.

8. A chain saw guide bar according to claim 7, and further including a chain guide groove in said parts, said chain guide groove having substantially the same thickness as said tongue and groove portions of said joint.

* * * * *